US005200063A

United States Patent [19]

Neskora et al.

[11] Patent Number: 5,200,063

[45] Date of Patent: * Apr. 6, 1993

[54] COAL HYDROCONVERSION PROCESS COMPRISING SOLVENT ENHANCED PRETREATMENT WITH CARBON MONOXIDE

[75] Inventors: Dan R. Neskora; Stephen N. Vaughn; W. Neal Mitchell; Calude C. Culross; Steve D. Reynolds, all of Baton Rouge, La.; Edward Effron, Springfield, N.J.

[73] Assignee: Exxon Research and Engineering Company, Florham Park, N.J.

[ * ] Notice: The portion of the term of this patent subsequent to Jun. 25, 2008 has been disclaimed.

[21] Appl. No.: 774,446

[22] Filed: Oct. 9, 1991

Related U.S. Application Data

[63] Continuation of Ser. No. 541,851, Jun. 21, 1990, abandoned.

[51] Int. Cl.[5] ..... C10G 1/00; C10G 1/06; C10G 1/08

[52] U.S. Cl. ..... 208/400; 208/403; 208/413; 208/419; 208/421; 208/422; 208/423; 208/430; 208/431; 208/433; 208/434; 208/435

[58] Field of Search ..... 208/413, 419, 421, 422, 208/423, 430, 431, 433, 434, 435, 403

[56] References Cited

U.S. PATENT DOCUMENTS

| | | | |
|---|---|---|---|
| 4,222,846 | 9/1980 | Schmid | 208/430 |
| 4,266,083 | 5/1981 | Huang | 208/419 |
| 4,369,106 | 1/1983 | Aldridge et al. | 208/419 |
| 4,417,972 | 11/1983 | Francis et al. | 208/419 |
| 4,832,831 | 5/1989 | Meyer et al. | 208/431 |
| 5,026,475 | 6/1991 | Stuntz et al. | 208/403 |

*Primary Examiner*—Theodore Morris
*Assistant Examiner*—P. L. Hailey
*Attorney, Agent, or Firm*—Roy J. Ott

[57] ABSTRACT

This invention is directed to a staged process for producing liquids from coal or similar carbonaceous feeds combining a pretreatment stage and a liquefaction stage. In the process, the feed is dispersed in an organic solvent and reacted with carbon monoxide at an elevated temperature and pressure. The so pretreated coal is sent to a liquefaction reactor, wherein the coal is reacted in the presence of hydrogen and catalyst to produce valuable liquid fuels or feedstocks.

22 Claims, 3 Drawing Sheets

COAL HYDROCONVERSION PROCESS COMPRISING SOLVENT ENHANCED PRETREATMENT WITH CARBON MONOXIDE

This is a continuation of application Ser. No. 541,851, filed Jun. 21, 1990, now abandoned.

This invention relates to a process for liquefying coal, in particular, a multi-stage process comprising in sequence a pretreatment stage and a catalytic hydroconversion stage.

BACKGROUND OF THE INVENTION

1. Field of the Invention

The petroleum industry has long been interested in the production of "synthetic" liquid fuels from non-petroleum solid fossil fuel sources. It is hoped that economic non-petroleum sources of liquid fuel will help the petroleum industry to meet growing energy requirements and decrease dependence on foreign supplies.

Coal is the most readily available and most abundant solid fossil fuel, others being tar sands and oil shale. The United States is particularly richly endowed with well distributed coal resources. Additionally, in the conversion of coal to synthetic fuels, it is possible to obtain liquid yields of about three to four barrels per ton of dry coal, or about four times the liquid yield/ton of other solid fossil fuels such as tar sands or shale, because these resources contain a much higher proportion of mineral matter.

Despite the continued interest and efforts of the petroleum industry in coal liquefaction technology, further improvements are necessary before it can reach full economic status. Maximizing the yield of coal liquids is important to the economics of coal liquefaction.

The present invention relates to an improved process for converting coal to liquid hydrocarbon products in a catalytic hydroconversion process. The improvement relates to a coal pretreatment stage comprising subjecting a slurry of coal, dispersed in an organic solvent, to carbon monoxide under specific pressure and temperature conditions. Such pretreatment improves the reactivity of the coal in the subsequent hydroconversion (liquefaction) stage of the overall process.

2. Description of the Prior Art

The known processes for producing liquid fuels from coal can be grouped into four broad categories: direct hydrogenation, donor solvent hydrogenation, Fischer-Tropsch synthesis (via gasification), and pyrolysis (see Kirk Othmer—Fuels). The present invention falls into the category of direct hydrogenation.

The direct hydrogenation of coal in the presence of solvent and catalyst was first developed in Germany prior to World War II. In such a process, a slurry of coal in a suitable solvent was reacted in the presence of molecular hydrogen at an elevated temperature and pressure.

A number of previous co-assigned patents disclose coal liquefaction processes utilizing hydroconversion catalysts which are micron sized particles comprised of a metal sulfide in a carbonaceous matrix. These catalysts are generally formed from certain soluble or highly dispersed organometallic or inorganic compounds or precursors. These precursors are converted into catalyst particles by heating in the presence of an hydrogen-containing gas. The catalyst particles are highly dispersed in the feed being treated during hydroconversion. Among the various patents in this area are U.S. Pat. No. 4,077,867; U.S. Pat. No. 4,094,765; U.S. Pat. No. 4,149,959; U.S. Pat. No. 4,298,454; and U.S. Pat. No. 4,793,916. Other patents disclose catalysts similar to the above except that the catalytically active metal compound is supported on finely divided particles of solid metals and metal alloys, for example as disclosed in U.S. Pat. Nos. 4,295,995 and 4,357,229.

The conversion of coal in the presence of high temperature steam and carbon monoxide is well known, dating back to Fischer and Schrader in 1921 (F. Fisher & H. Schrader, Bennst. Chem., 2, 257, 1921). Several liquefaction processes, including the U.S. Bureau of Mines COSTEAM process (H. R. Appell, E. C. Moroni, R. D. Miller, Energy Sources, 3, 163, (1971), have been developed based on using aqueous/CO or aqueous/syngas at 750°–850° F. in the primary conversion step.

An object of the present invention is to provide a novel process for the conversion (liquefaction) of carbonaceous solids such as coal in order to produce valuable liquid hydrocarbonaceous products.

A further object of the present invention is to provide an improved process for producing liquid hydrocarbonaceous products from coal, the improvement comprising utilizing a pretreatment step wherein coal, slurried in an organic solvent phase, is subjected to reaction with carbon monoxide.

A particular object of the present invention is to pretreat coal in a specific temperature range to generate a more reactive coal for coal liquefaction, thereby obtaining more products, with higher selectivity to liquids over gases.

Another object of the present invention is to improve the efficiency in the utilization of molecular hydrogen in the transformation of coal to valuable liquids.

Additional advantages of the present coal conversion process will become apparent in the following description.

SUMMARY OF THE INVENTION

In accordance with the present invention, there is provided a process for liquefying coal to produce an oil, which comprises: (a) pretreating the coal by forming a mixture comprising coal, carbon monoxide and an organic solvent, and subjecting the mixture to an elevated temperature and pressure; (b) removing gases from the coal mixture; (c) forming a subsequent mixture of the pretreated coal, solvent, and catalyst, wherein the catalyst is a carbonaceous supported metal containing oxide or sulfide, preferably a conversion product of an oil-soluble metal containing compound, said metal being selected from the group consisting of Groups VA, VIA, VIIA and VIIIA of the Periodic Table of Elements, and mixtures thereof; (d) reacting the latter mixture with a gas largely comprised of molecular hydrogen under coal liquefaction conditions, in a liquefaction zone, and (e) recovering an oil product.

In accordance with another embodiment of the invention, there is provided a process for liquefying coal to produce an oil, which comprises: (a) subjecting a mixture of coal, carbon monoxide, and an organic solvent to a temperature of 550° F. to 650° F. and a carbon monoxide partial pressure of 500 to 5000 psi for a period of at least 10 minutes, (b) removing gases from the coal mixture; (c) forming a subsequent mixture of the pretreated coal, solvent, and catalyst, wherein the catalyst is a carbonaceous supported metal-containing oxide or sulfide, preferably a conversion product of an organic oil-soluble metal containing compound, said metal being selected from the group consisting of Groups VA, VIA, VIIA and VIIIA of the Periodic Table of the Elements and mixtures thereof; (d) reacting the latter mixture with a gas comprising molecular hydrogen under coal liquefaction conditions, in a liquefaction zone, and (e) recovering an oil product.

BRIEF DESCRIPTION OF DRAWINGS

The process of the invention will be more clearly understood upon reference to the detailed discussion below and upon reference to the drawings wherein.

DESCRIPTION OF THE PREFERRED EMBODIMENTS

Figure 1:
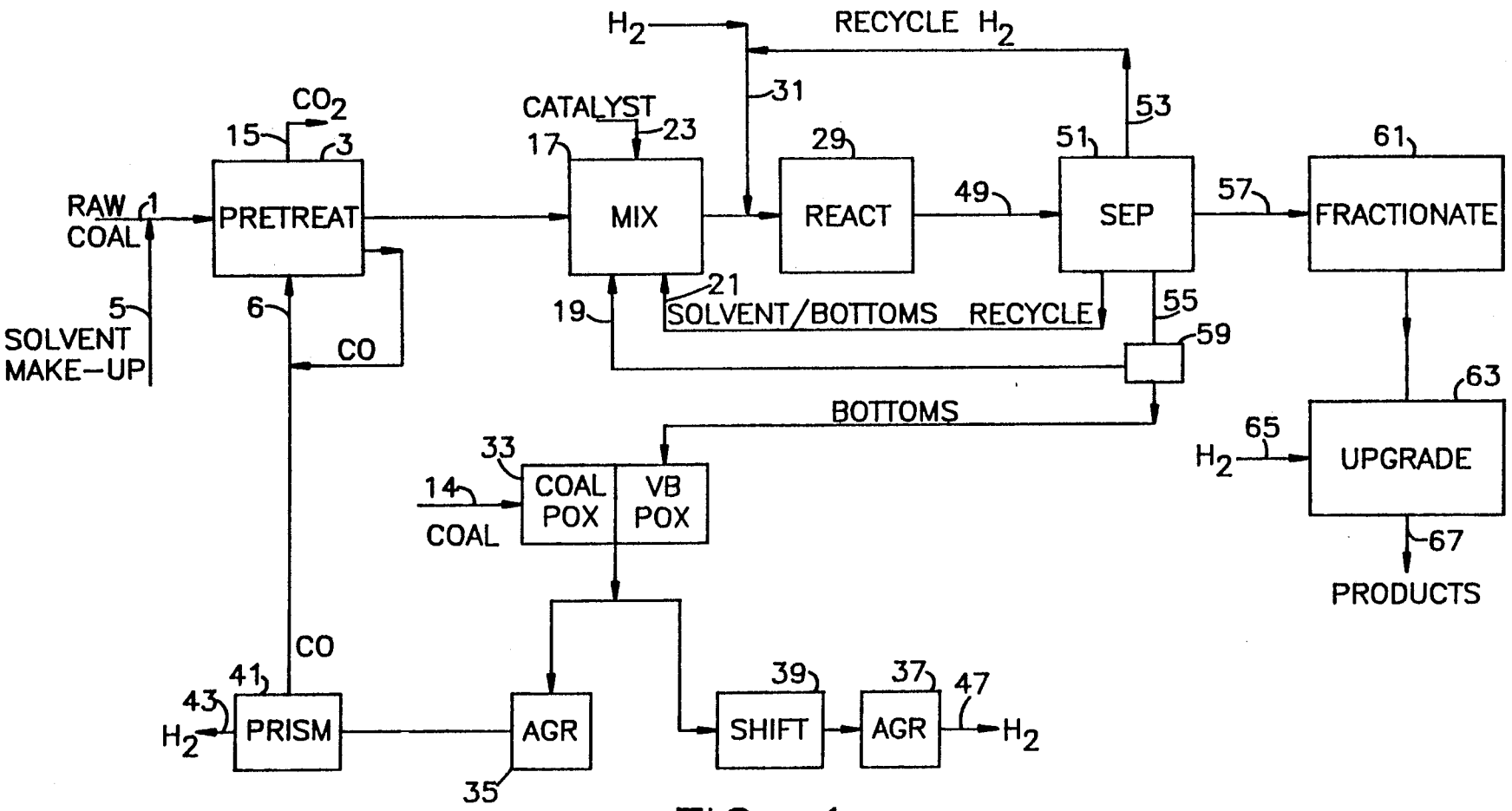
FIG. 1 shows a process flow diagram illustrating the subject invention wherein coal is pretreated in the presence of carbon monoxide and thereafter converted into valuable liquids.

The process of the invention is generally applicable to hydroconvert coal to coal liquids (i.e., an oil or normally liquid hydrocarbon product) under catalytic hydroconversion conditions. The process comprises a pretreatment stage and a liquefaction stage. In the pretreatment stage, a coal feed dispersed in an organic solvent is pretreated with carbon monoxide (or a gaseous mixture such as syngas containing carbon monoxide) at an elevated temperature and pressure. During this stage, only small amounts of very light liquids are formed. The coal is separated from gases and thereafter sent to a liquefaction reactor. In the liquefaction reactor the coal is reacted at an elevated temperature in the presence of hydrogen, a vehicle solvent and catalyst to produce coal liquids.

The term "coal" is used herein to designate a normally solid carbonaceous material including all ranks of coal below anthracite, such as bituminous coal, subbituminous coal, lignite, peat and mixtures thereof. The sub-bituminous and lower ranks of coal are particularly preferred.

The raw material for the present process is coal that has been first reduced to a particulate or comminuted form. The coal is suitably ground or pulverized to provide particles of a size ranging from 10 microns up to about ¼ inch particle size diameter, typically about 8 mesh (Tyler).

Pretreatment. According to the present process, the coal feedstock is pretreated by being dispersed in an organic solvent and subjected to carbon monoxide. Coal is reacted in the pretreatment stage at relatively mild temperatures. A limited amount of volatile hydrocarbon liquids are produced during the pretreatment stage. However, the coal is depolymerized, and the moisture and oxygen levels are reduced. After such pretreatment, not only are the properties of the coal upgraded, but the coal shows enhanced reactivity for further processing. In particular, the pretreatment significantly increases the coal's value as feedstock for coal liquefaction. The severity of the coal liquefaction conditions can be reduced while increasing liquid yields and selectivity to light liquids, reducing gas make, and lowering hydrogen consumption. The coal can reach a significantly higher daf wt % (dry ash free weight percent) conversion following pretreatment.

During pretreatment, coal depolymerization reactions occur. Depolymerization is detected by an increased solubility of the coal in various solvents. The ability of pretreatment to depolymerize coal has been variously attributed to bond breaking activity, or to the removal of potential cross-link sources which cause repolymerization to higher molecular weight products following thermal bond rupture.

During pretreatment, the coal in the form of particles are dispersed in an organic solvent which serves to transport carbon monoxide to the coal material. Although, in general, the presence of bulk water in addition to organic solvent will not adversely affect the benefits of pretreatment (increased coal volatile matter and improved reactivity during hydroconversion), it is preferred that the coal particles are dispersed in a single liquid phase comprising an organic solvent such as a coal distillate.

Some water is required for the pretreatment reaction system in order to provide for hydrogenation of the coal material. However, the water may be provided by the as-received coal equilibrium moisture (also called "physical water") and/or by chemical water in the coal ("chemical water" is water made available during the conditions of pretreatment and may comprise water of hydration in the coal minerals). One proposed reaction mechanism is that during pretreatment the carbon monoxide reacts with water in the coal matrix and forms reactive intermediates which hydrogenate the coal and generate carbon dioxide.

In practice, the present process requires no water to be added to the as-received coal, and no liquid water phase is necessary during pretreatment. Typically, about 30% by weight water may be present as moisture in the as-received coal, but this is insufficient to form an aqueous phase during pretreatment. Higher amounts of water, for example, in lignite, may be present and, although not preferred, is generally not detrimental to pretreatment. However, hydroconversion reactivity of the coal may suffer when both organic solvent and water are present at intermediate levels.

A major benefit of the present process is that, since additional water is not required during pretreatment, no separation by filtration of liquid water from the pretreated coal is necessary, after it exits the pretreatment reactor. Separation of water from the coal may be accomplished in the gas phase by interstage gas separation.

The ratio by weight of organic solvent-to-dry coal, is suitably 4:1 to 1:1, preferably about 3:1 to 1.5:1. The ratio of water-to-dry coal at conditions is below about 0.5:1 and the inlet ratio of water-to-dry coal is below about 1:1. (The term "at conditions", as compared to "inlet conditions", excludes water evaporated to steam, and water lost via the water-gas-shift reaction.)

Preferably, the coal during pretreatment is slurried with a process-derived hydrocarbon solvent suitable for ultimate use in the liquefaction stage. Exemplary solvents are 400+° F. distillates up to and including VGO solvent and recycle liquefaction bottoms.

Mixtures of organic solvents are suitable, for example, a solvent mixture may include alcohols such as isopropyl alcohol, ketones, phenols, carboxylic acids, and the like, which are by-products of the pretreatment stage. Consequently, they may be concentrated and accumulated in a recycle stream.

The pretreatment temperature has a large impact on the quality of coal. A temperature within the range of 550° to 700° F. is suitable, preferably 575° to 625° F.

An alternative embodiment is to temperature stage the pretreatment reactions by initially maintaining the temperature in the above mentioned 550° to 650° F. range for part of the time and then increasing the temperature to a range between 650° to 800° F.

The temperature during pretreatment can significantly effect the volatile matter content of the pretreated coal. Volatile matter is thought to be of particular importance in determining how well a particular coal will react in coal liquefaction. Concurrent measurements of other affected properties, such as coal oxygen content reduction and solubility, generally increase with increasing temperature.

Another important pretreatment process condition is carbon monoxide (CO) pressure. There is generally an increasing improvement in coal properties with increasing CO partial pressure ($P_{co}$). A suitable range is 500 to 1500 psi (initial) at ambient temperature, preferably about 850 to 1000 psi. There is also generally an increasing improvement in coal properties with increasing weight % CO fed relative to coal, or "treat". A suitable treat range is 40 to 100 weight % (dry coal basis), preferably about 50 to 80 weight % CO.

The total pressure at conditions (including $H_2O$ vapors, $CO_2$, $H_2$, CO, and $C_1$–$C_4$) is in the range of about 1800 to 4500 psi, preferably about 2800 to 3400 psi, depending on $P_{co}$ and the temperature, which in turn determines the solvent partial pressure.

Generally, coal quality improves with increasing residence time in the pretreatment zone. A suitable residence time at 600° F. ranges from about 10 minutes to 5 hours, preferably, from an economic standpoint, 20 minutes to 2 hours, most preferably about 80 minutes.

Efficient mixing and good contact between the CO and coal in the pretreatment reactor is desirable. This can be accomplished with a mechanical stirrer and/or with stationary baffles that create high turbulence, or properly designed inlet gas sparges that produce small gas bubbles.

Pretreatment of coal according to the present invention is suitably carried out in a reactor of conventional construction and design capable of withstanding the heretofore described conditions of pretreatment. A stainless steel cylindrical vessel with inlet lines for the coal slurry and carbon monoxide and product removal lines is suitable.

Certain soluble acids or metal salts of organic acids or bases, particularly those made in the system, all can act as promotors to solubilize the coal. The most preferred promotors are metal salts wherein the metal is in Group I or Group II of the Periodic Table, for example sodium or calcium formate. Other preferred promotors are ammonium sulfide, ammonium bisulfide, or hydrogen sulfide. The promotors should be present in the system in the amount by weight of 0.5 to 50%, preferably 0.5 to 10%, and most preferably 1 to 5%. As indicated below, they may be sprayed in aqueous solution onto the crushed coal.

Hydroconversion. Following pretreatment, the coal is subjected to hydroconversion or liquefaction where the coal is reacted with molecular hydrogen in the presence of a catalyst. The purpose is to generate a high yield of lighter liquid products or coal oil.

The solvents employed in the liquefaction stage of the present invention, which may include the organic solvent employed during pretreatment, may contain anywhere from ½ to about 2 weight percent donatable hydrogen, based on the weight of the total solvent. Preferred solvents include coal derived liquids such as coal vacuum gas oils (VGO) or mixtures thereof, for example, a mixture of compounds having an atmospheric boiling point ranging from about 350° F. to about 1050° F., more preferably ranging from about 650° F. to less than about 1000° F. Other suitable solvents include aromatic compounds such as alkylbenzenes, alkylnaphthalenes, alkylated polycyclic aromatics, heteroaromatics, unhydrogenated or hydrogenated creosote oil, tetralin, intermediate product streams from catalytic cracking of petroleum feedstocks, shale oil, or virgin petroleum streams such as vacuum gas oil or residuum, etc. and mixtures thereof.

The catalyst employed in the hydroconversion stage is suitably a conventionally supported metal sulfide, for example nickel and molybdenum, on a solid porous alumina support. Preferably, the catalyst is comprised of well-dispersed, micron or submicron size particles. The catalyst may be a hydrocarbonaceous supported metal compound. Most preferably, the catalyst is formed from a precursor which is an organic oil-soluble metal compound. The precursor is typically added to the solvent so as to form a mixture of oil soluble metal compound, solvent and coal in a mixing zone. The oil-soluble metal containing compound make-up (not including additional amounts from recycle) is added in an amount sufficient to provide from about 10 to less than 5000 wppm, preferably from about 25 to 950 wppm, more preferably, from about 50 to 700 wppm, most preferably from about 50 to 400 wppm, of the oil-soluble metal compound, calculated as the elemental metal, based on the weight of coal in the mixture. Catalyst make-up rates are suitably from about 30 ppm to 500 ppm on coal. The remainder will normally be supplied from recycling the unconverted coal or bottoms, which contain active catalyst.

Suitable oil-soluble metal compounds convertible to active catalysts under process conditions include (1) inorganic metal compounds such as halides, oxyhalides, hydrated oxides, heteropoly acids (e.g., phosphomolybdic acid, molybdosilicic acid); (2) metal salts of organic acids such as acyclic and alicyclic aliphatic carboxylic acids containing two or more carbon atoms (e.g., naphthenic acids); aromatic carboxylic acids (e.g., toluic acid); sulfonic acids (e.g., toluenesulfonic acid); sulfinic acids; mercaptans, xanthic acid; phenols, di- and polyhydroxy aromatic compounds; (3) organometallic compounds such as metal chelates (e.g., with 1,3-diketones, ethylene diamine, ethylene diamine tetraacetic acid, etc.); (4) metal salts of organic amines such as aliphatic amines, aromatic amines, and quaternary ammonium compounds.

The metal constituent of the oil soluble metal compound is selected from the group consisting of Groups VA, VIA, VIIA and VIIIA of the Periodic Table of the Elements, and mixtures thereof, in accordance with the Table published by Sargent-Welch Scientific Company, copyright 1979, that is, vanadium, niobium, tantalum, chromium, molybdenum, tungsten, manganese, rhenium, iron, cobalt, nickel and the noble metals including platinum, iridium, palladium, osmium, ruthenium and rhodium. The preferred metal constituent of the oil soluble metal compound is selected from the group consisting of molybdenum, vanadium and chromium. More preferably, the metal constituent of the oil soluble metal compound is selected from the group consisting of molybdenum and chromium. Most preferably, the metal constituent of the oil soluble metal compound is molybdenum. Preferred compounds of the metals include the salts of acyclic (straight or branched chain) aliphatic carboxylic acids, salts of alicyclic aliphatic carboxylic acids, heteropolyacids, hydrated oxides, carbonyls, phenolates and organic amine salts. More preferred types of metal compounds are the heteropoly acids, e.g., phosphomolybdic acid (PMA). Another preferred metal compound is a salt of an alicyclic aliphatic carboxylic acid such as a metal naphthenate. Preferred compounds are molybdenum naphthenate, vanadium naphthenate, chromium naphthenate, and molybdenum or nickel-dibutyl dithiocarbamates.

The preferred catalyst particles, containing a metal sulfide in a carbonaceous matrix formed within the process, are uniformly dispersed throughout the feed. Because of their ultra small size, generally 0.02 to 2 microns in average diameter, there are typically several orders of magnitude more of these catalyst particles per cubic centimeter of oil than is possible in an expanded or fixed bed of conventional catalyst particles. The high degree of catalyst dispersion and ready access to active catalyst sites affords good reactivity control of the reactions.

Since the catalyst is effective in weight parts per million quantities of metal on feed, it is economically feasible to use them on a once through basis, although some recycle is preferred.

Various methods can be used to convert a catalyst precursor, in the coal-solvent slurry, to an active catalyst. It is usually better to form the catalyst in-situ in order to obtain better dispersion. One method of forming the catalyst from the precursor or oil-soluble metal compound is to heat in a premixing unit prior to the liquefaction reaction, the mixture of metal compound, coal and solvent to a temperature ranging from about 615° F. to about 820° F. and at a pressure ranging from about 500 to about 5000 psig, in the presence of a hydrogen-containing gas. If the precursor does not have sulfur, a sulfur-containing reagent such as $H_2S$, $CS_2$ (liquid), or elemental sulfur may be introduced. The hydrogen-containing gas may be pure hydrogen but will generally be a hydrogen stream containing some other gaseous contaminants, for example, the hydrogen-containing effluent produced in a reforming process.

If $H_2S$ is employed as the source of sulfur to activate the catalyst, then hydrogen sulfide may suitably comprise from about ½ to about 10 mole percent of the hydrogen-containing gas mixture. Hydrogen sulfide may be mixed with hydrogen gas in an inlet pipe and heated up to reaction temperature in a preheater or may be part of the recycle gas stream. High sulfur coals may not require an additional source of sulfur. The catalyst precursor treatment is suitably conducted for a period ranging from about 5 minutes to about 2 hours, preferably for a period ranging from about 10 minutes to about 1 hour, depending on the composition of the coal and the specific catalyst precursor used. Such a thermal treatment in the presence of hydrogen or in the presence of hydrogen and hydrogen sulfide converts the metal compound to the corresponding metal containing active catalyst which acts also as a coking inhibitor.

Another method of converting a catalyst precursor or oil-soluble metal compound to a catalyst for use in the present process is to react the mixture of metal compound, coal and solvent with a hydrogen-containing gas in the liquefaction zone itself at coal liquefaction conditions.

Although the oil-soluble metal compound (catalyst precursor) is preferably added to a solvent, and the catalyst formed in-situ within the slurry of coal and solvent, it is also possible to add already formed catalyst to the solvent, although as mentioned above, the dispersion may not be as good.

In any case, a mixture of catalyst, solvent, and coal occurs in the coal hydroconversion zone which will now be described. The coal liquefaction zone is maintained at a temperature ranging from about 650° to 950° F., preferably from about 650° to 850° F., more preferably between about 750° and 800° F., and a hydrogen partial pressure ranging from about 500 psig to about 5000 psig, preferably from about 1200 to about 3000 psig. The space velocity, defined as the volume of the coal and solvent feedstock per hour per volume of reactor (V/H/V), may vary widely depending on the desired conversion level. Suitable space velocities may range broadly from about 0.1 to 10 volume feed per hour per volume of reactor, preferably from about 0.25 to 6 V/H/V, more preferably from about 0.5 to 2 V/H/V.

With bottoms recycle, a suitable solvent:coal:bottoms ratio by weight to the liquefaction zone will be within the range of about 2.5:1:0 to about 0.6:1:2. Reducing the solvent to solids ratio improves the thermal efficiency of the process because the reactor size is reduced for a given coal throughput, or allows for more throughput. Reducing the bottoms-to-coal ratio is another option. Also when a heavier solvent is recycled at a lower solvent to solids ratio, less heat energy is required because less solvent is distilled during subsequent fractionation. A typical process solvent boiling range is from 450° to 650° F. IBP to about 1000° F. FBP.

The range of process conditions recommended for the hydroconversion (liquefaction) stage, according to an embodiment considered the best mode, is summarized in Table A below:

TABLE A

| Variable | Broad Range | Preferred Range |
|---|---|---|
| Liquefaction Temperature, °F. | 650–950 | 650–800 |
| Pressure, psig | 1500–3000 | 2500–3000 |
| Slurry, Residence Time, Min | 25–480 | 60–240 |
| Solvent/Coal Ratio, by wt | 0.6–2.5 | 0.8–1.2 |
| Bottoms/Coal Ratio, by wt | 0–2 | 0.5–1.5 |
| $H_2$ treat, wt % on coal | 4–12 | 5–9 |
| Sulfur on Coal, wt % | 0–10 | 0–4 |
| Solvent Boiling Range, °F. | 450–1000 | 650–1000 |
| Catalyst Metal on coal, wppm | 100–5000 | 300–1000 |

A conversion of about 80 percent or higher to various products based on wt % daf coal is typically achieved. Normally, low liquefaction temperature results in low coal reactivity, for example, in one run at low temperature (700° F./8 hour) the liquid yield was significantly below another run at higher temperature (840° F./1 hour) with identical 1000 ppm loadings of molybdenum catalyst. However, liquefaction reactivity which allows good conversion and good liquids selectivity can be achieved at lower temperatures when the coal is first pretreated in the above-described manner.

The process of the invention may be conducted either as a batch or as a continuous type process. Suitably, there are on-site upgrading units to obtain finished products, for example transportation fuels.

DESCRIPTION OF THE DRAWINGS

Referring now to FIG. 1, pulverized coal is introduced by line 1 into a mixing and pretreatment zone 3 wherein the coal is mixed with an organic solvent and carbon monoxide introduced by lines 5 and 6, respectively. This coal mixture is subjected to elevated temperature and pressure conditions as described heretofore. The gases remaining or produced in the pretreatment zone, typically $CO_2$, CO, $H_2O$, $H_2$ and $C_1$–$C_4$ hydrocarbons, are removed via line 15.

Since no water, in addition to that in the original coal, is required in the pretreatment zone 3, dewatering of the coal mixture is unnecessary. Whatever water is present can be largely removed in the gaseous mixture leaving the pretreatment zone by line 15. The solvent used in the pretreatment zone can be continuously used in the subsequent liquefaction stage.

Figure 2:
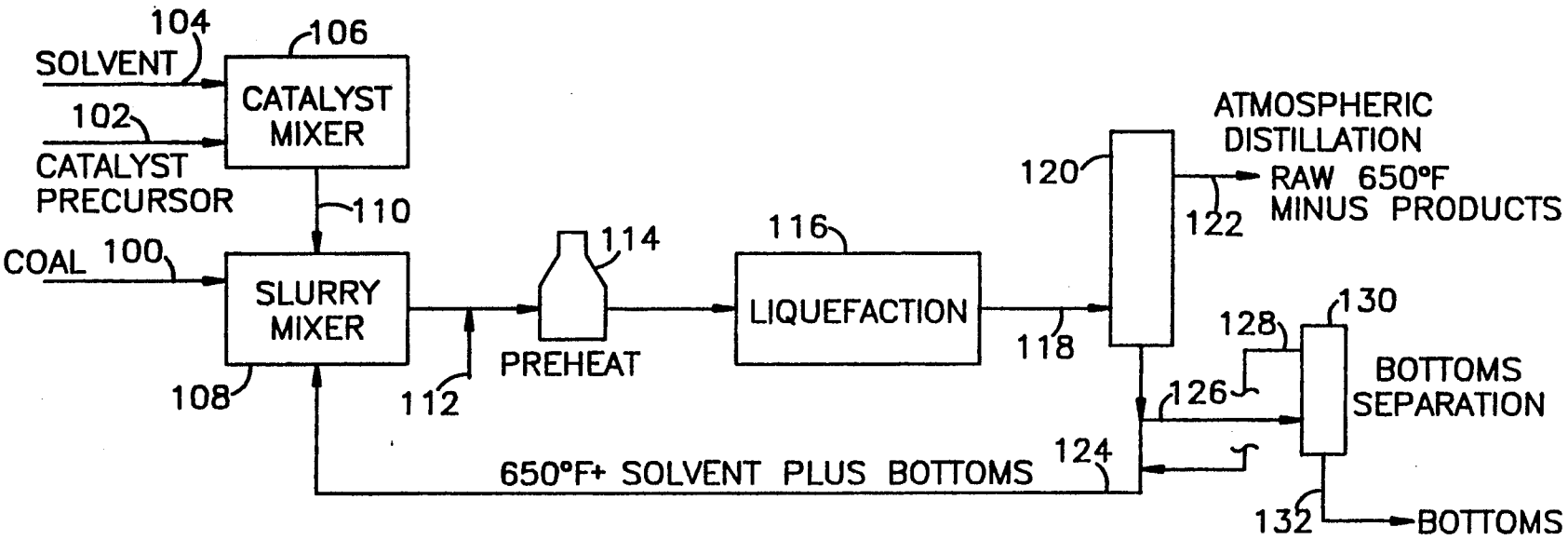
FIG. 2 shows a process flow diagram illustrating fractionation of a liquid effluent from a hydroconversion reactor.

Referring to FIG. 1, following pretreatment, the coal enters a mixing zone 17 (analogously in FIG. 2, the coal in line 100 enters slurry mixer 108) wherein recycled 650° F.+ bottoms is added by line 21 (124 in FIG. 2) to the coal. Additionally, recovered solvent from downstream can be introduced via line 19 (128 in FIG. 2). A catalyst precursor containing solvent is introduced into the mixing zone 17 via line 23. In FIG. 2, a solvent stream 104 and catalyst precursor 102 are introduced into catalyst mixing zone 106. The components in the mixing zone are intimately mixed to form a homogenous slurry.

The mixture of oil-soluble metal catalyst precursor, solvent, and coal is introduced into preheating zone 114 as shown in FIG. 2. A gaseous mixture comprising hydrogen, and optionally hydrogen sulfide, is introduced to this zone via line 112. The preheating zone is suitably maintained at a temperature ranging from about 600°–700° F. and a pressure of about 2000–2500 psi.

The coal and catalyst slurry are then introduced into a liquefaction zone 29 (or 116 in FIG. 2). The liquefaction reactor may be any suitable vessel or reactor capable of withstanding the desired temperature and pressure liquefaction conditions. Typically, there are a plurality of staged liquefaction reactors (not shown), the conditions of each reaction zone being set to maximize desired equilibrium limits and kinetic rates and to obtain the best profile of products.

A hydrogen-containing gas is introduced directly into the liquefaction reactor 29 via line 31 for temperature control purposes. The hydrogen-containing gas may be pure hydrogen, but will generally be a hydrogen stream containing some other gaseous contaminants, for example, the hydrogen recycle gas. Suitable hydrogen-containing gas mixtures for introduction into the liquefaction zone include raw synthesis gas, that is, a gas containing hydrogen and from about 5 to about 50, preferably from about 10 to 30 mole percent carbon monoxide. Another suitable hydrogen containing gas is obtainable from the steam reforming of natural gas. Pure hydrogen if available is also suitable.

Preferably, a portion of the hydrogen is provided by a partial oxidation unit 33. The remainder of the hydrogen may be generated by conventional coal partial oxidation or natural gas reforming. A suitable partial oxidation process is disclosed in U.S. Pat. No. 5,026,475. In that process, molten coal bottoms are pumped into a partial oxidation reactor, essentially a gasifier, in the form of small droplets, where it is mixed with oxygen (for example, from an oxygen plant) and steam. The amount of oxygen is adjusted so that oxidation of the coal material all the way to $CO_2$ does not occur. Instead, the following reactions occur:

$$2C+O_2 \rightarrow 2CO$$

$$C+H_2O \rightarrow CO+H_2$$

The mixture of CO and $H_2$ produced, known as "synthesis gas", can be sent to a separation device, for example a PRISM membrane unit 41 (registered trademark of Monsanto Corporation) following acid gas removal in separator 35. $H_2$ is removed as a by-product via line 43 and the CO in line 6 is used for the pretreatment step. In addition, some of the gases from the partial oxidation unit can be passed over a Ni catalyst and contacted with additional water in reactor 39 to produce $CO_2$ and $H_2$ according to the following water gas shift reaction:

$$CO+H_2O \rightleftharpoons CO_2+H_2$$

Following acid gas removal in separator 37, $H_2$ is obtained in line 47. The hydrogen in lines 43 and 47 can be used in the liquefaction reaction zone.

It is noted in FIG. 1 that there are two partial oxidation units. The first (shown on the left and labeled coal POX) may be referred to as "slurry partial oxidation", wherein the coal is not pretreated and basically in solid form. The second (shown on the right and labeled VB POX) may be referred to as "molten liquid vacuum bottoms partial oxidation".

Returning to the liquefaction zone 29 in FIG. 1, the effluent in line 49 comprises gases, an oil product and a solid residue. The effluent is passed to a separation zone 51 (including an atmospheric pipe-still) which gases are removed overhead by line 53. The gases typically comprise $C_1$–$C_4$ hydrocarbons, $H_2$, and acid gases. The $C_1$–$C_4$ gases may be used as fuel, for example to preheat the coal. The $H_2$ may be recycled to the coal liquefaction zone via line 31 or used for upgrading the liquid products. The gases may be first scrubbed by conventional methods to remove any undesired amounts of hydrogen sulfide, ammonia and carbon dioxide.

The solids component of the liquefaction effluent may be separated from the oil product by conventional means, for example, by settling, centrifuging or filtration of the oil-solids slurry. At least a portion of the separated solids or solids concentrate may be recycled directly to the coal liquefaction zone or recycled to the coal-solvent chargestock via line 21. Preferably a fractionator or vacuum separator 59 is utilized to separate solvent and bottoms in line 55. It is advantageous to send a bottoms stream from vacuum separator 59 as raw material to the partial oxidation unit 33, where it can be used to produce $H_2$ for lines 43 and 47, as described above and CO for the pretreatment step via line 6.

The hydrocarbonaceous oil produced in the liquefaction zone is removed from separation zone 51 by line 57 and passed to fractionation zone 61 wherein various boiling range fractions can be obtained, for example a heavy fraction, an intermediate fraction, and a light fraction. These fractions may be sent to an upgrading zone 63, where treatment with hydrogen in line 65, optionally in the presence of hydrotreating catalysts, yields final products in line 67. In a preferred embodiment of the present invention, at least a portion of the oil product, which includes the recovered solvent, is recycled via vacuum separator 59 and line 19, into mixing zone 17 or directly into the coal liquefaction zone 29.

Various process options for treating the liquid effluent which is removed from the coal liquefaction reactor 29 are possible and will be recognized by those skilled in the art.

For example, referring to FIG. 2, a preferred embodiment is shown for treating the liquid products. The liquid effluent 118 from liquefaction reactor 116 is fractionated in an atmospheric fractionator 120 into raw 650° F.− products in line 122. A portion of the atmospheric bottoms is recycled in recycle stream 124 in the desired ratio with coal and catalyst. The atmospheric bottoms required to purge ash are routed in line 126 to a bottoms separation 130 to recover additional 650° F.+ liquids in line 128 for use as solvent. This separator 130 may be a vacuum distillation tower, solvent extraction unit, etc. The residual vacuum bottoms in line 132 can be utilized as feed to a partial oxidation unit, a hybrid boiler, or a conventional boiler for process heat or hydrogen.

The recycle atmospheric bottoms stream contains active, well-dispersed microcatalyst. Make-up catalyst is needed to maintain catalyst concentration due to loss of catalyst purged with the bottoms.

The following examples illustrate preferred embodiments and certain advantages of the present process. These examples are not intended to limit the broad scope of the present invention. Other advantages and embodiments of the present invention will be apparent to those skilled in the art from the description provided herein.

EXAMPLE 1

This example illustrates the effect and advantages of solvent enhanced carbon monoxide (CO) pretreatment in connection with the hydroconversion of coal. Pretreatment in hydrocarbon solvent under a CO atmosphere improves hydroconversion relative to no pretreatment, and to other potential pretreatments.

Pretreatment and liquefaction experiments were performed in minibomb reactors consisting of a 1" Swagelok cap and plug set which had a volume of 11.11 cc. Coal and other solid and liquid reactants were charged in amounts so as to leave a void volume which would achieve the desired gas treat on coal (wt % reactive gas on dry coal) when pressurized with reactive gas at the target run pressure. Conditions in the pretreatment runs are summarized in Table 1. Runs B and G were with no treatment gas, D and E were with the $H_2$ pretreatment, and C and F were with CO pretreatment. Run labels in Table 1 are for cross-reference purposes with respect to other Tables. The pretreatment and hydroconversion segments of a run bear the same letter label. Conditions in the liquefaction runs are summarized in Table 2.

Pretreatment run E in Table 1 is meant to simulate near optimum hydrogen soak conditions in a preheater preceeding a conventional liquefaction reactor. Hydrogen sulfide in the pretreatment segments of runs F and G was generated in situ by reaction of water with carbon disulfide.

In the pretreatment experiments, the coal was a Wyoming subbituminous coal, the coal-derived solvent had a nominal boiling range of 650°-1000° F., and the catalyst precursor was molybdenum hexacarbonyl. The ratio of solvent to coal was 1:1. All runs except A and E contained roughly 50% total water on dry coal, of which 18.8% was in the coal pores.

In order to pressurize prior to pretreatment, the loosely threaded minibomb was totally enclosed and sealed in a pressurizing cell. The cell and minibomb were evacuated with an in-house vacuum system to remove air, and overpressured with carbon monoxide or hydrogen, except where the minibomb contained carbon disulfide (pretreatment runs F and G). In this case, the sealed minibomb was placed in the pressurizing cell, and the minibomb was not opened until the cell had been evacuated with house vacuum and overpressured with reactant gas. This avoided the loss of volatile carbon disulfide. The pressure was let down to the target level via a fine metering valve and followed with a pressure transducer with which the pressurizing cell was equipped. The cell was mounted in a vice, and an outside nut on the cell, connected to the minibomb inside via a pressure-tight shaft and socket within the cell, was turned so as to seal the pressurized minibomb. As many as 12 minibombs could be run at once.

The minibombs were mounted on a rack and agitated at 250 cycles per minute in a heated, fluidized sandbath held at the desired temperature. The minibombs were not equipped with an internal thermocouple, but previous measurements indicated that less than three minutes are required to reach reaction temperature. After the desired residence time was reached, the minibombs were removed from the sandbath and cooled in air.

The total gas product was collected in the pressurizing cell, vented to an evacuated teflon lined stainless steel gas bottle, and analyzed by Mass Spectroscopy. The condensed phase product was passed on to hydroconversion after slight drying to remove residual water and very light products.

In the hydroconversion experiments, the molydenum catalyst precursor, if not already added in pretreatment, was added along with sulfur, and the minibomb was pressurized with hydrogen as described above for pretreatment. Hydroconversion was conducted at conditions listed in Table 2, and gas product was collected as described previously.

The 1000° F.− liquid hydrocarbon liquid product plus water after hydroconversion was defined by difference based on the weight of cyclohexane insolubles (see Maa et al., *Ind. Eng. Chem. Process Des. Dev.*, 23(2), 242 (1984)). Conversion calculated from the weight of cyclohexane insolubles was cross checked against the dry ash content of the cyclohexane insolubles.

The data in Table 3 provide a comparison of the effect of no pretreatment to various pretreatments under hydrogen and carbon monoxide in terms of hydroconversion. The base conversion with no pretreatment was 67.3% (wt % DAF untreated coal; run A). Pretreatment at temperature without carbon monoxide in hydrocarbon solvent made no change within experimental accuracy (results which differ by less than 3% are considered to be the same; run B). Pretreatment under CO in a hydrocarbon solvent made a considerably improvement in conversion to 74.9% (run C). Replacing CO with the same molar amount of hydrogen in pretreatment severely reduced conversion to 61.3% (run D). Optimizing the hydrogen soak by including a hydrogenation catalyst, among other things, merely served to prevent damage to the coal's reactivity; a conversion of 68.0% (run E) was the same as the unpretreated coal's conversion (run A). Adding hydrogen sulfide as a promoter in CO pretreatment further increased conversion to 81.0% (run F). In addition to promoting the beneficial effects of the CO pretreatment, it appeared from comparison of runs G and B that hydrogen sulfide might have been having an independent positive effect. Run G differed from B only in the presence of hydrogen sulfide, which increased conversion from 64.4% (run B) to 70.0% (run G).

In summary, an atmosphere of CO provides a pretreatment which increases hydroconversion, and is superior in its effect relative to hydrogen. The pretreatment is improved by adding hydrogen sulfide, which may be acting not only as a promoter, but may also have a direct positive impact on coal's reactivity.

TABLE 1

| | PRETREATMENT CONDITIONS | | | | | | | |
|---|---|---|---|---|---|---|---|---|
| RUN | PRETR. REACTIVE ATM/TREAT (WT % ON DRY COAL) | INITIAL HOT GAS IDEAL PRESSURE (PSI) | PROMOTER | PROMOTER LOADING (WT % ON DRY COAL) | COAL PORE MOISTURE (WT % ON DRY COAL) | ADDED MOISTURE (WT % ON DRY COAL) | TEMP (°F.) | RES. TIME (MIN) |
| A | None | None | None | None | dry | 0.0 | None | None |
| | | | | No Pretreatment | | | | |
| B | None/0.0 | None | None | 0.0 | 18.8 | 30.6 | 600 | 120 |
| G | None/0.0 | None | $H_2S$ | 16.5 | 18.8 | 30.6 | 600 | 120 |
| | | | | $H_2$ Pretreatment | | | | |
| D | $H_2$/4.3 | 1780 | None | 0.0 | 18.8 | 30.6 | 600 | 120 |
| E | $H_2$/6 | 2500 | Mo (CO) | 500 ppm | dry | 0.0 | 660 | 60 |
| | | | Sulfur | 1.0 | | | | |
| | | | | Co Pretreatment | | | | |
| C | CO/60 | 1780 | None | 0.0 | 18.8 | 30.6 | 600 | 120 |
| F | CO/60 | 1780 | $H_2S$ | 16.5 | 18.8 | 30.6 | 600 | 120 |

TABLE 2

| HYDROCONVERSION CONDITIONS |
|---|
| 800° F./160 min. |
| Pretreatment Solvent-Coal Mixture, or 1:1 Solvent:Untreated Coal |
| 1200 psi Cold $H_2$ @ ca. 9 wt % |
| ca. 500 ppm Mo (carbonyl) on Coal |
| ca. 0.5 wt % Sulfur on Coal to Sulfide Mo |

TABLE 3

| TOTAL (PRETREATMENT PLUS LIQUEFACTION) CONVERSION (WT % DAF UNTREATED COAL) | | |
|---|---|---|
| RUN | PRETREATMENT OPTION | TOTAL CONVERSION (DAF WT % UNTREATED COAL) |
| A | No Pretreatment | 67.3 |
| B | Water + Solvent Heat Soak (no CO) | 64.4 |
| C | Pretreatment (as claimed) | 74.9 |
| D | Hydrogen Soak (no Mo) | 61.3 |
| E | Hydrogen Soak + Mo + S | 68.0 |
| F | Pretreatment (as claimed) + $H_2S$ | 81.0 |
| G | $H_2S$ (no CO) | 70.0 |

EXAMPLE 2

Figure 3:
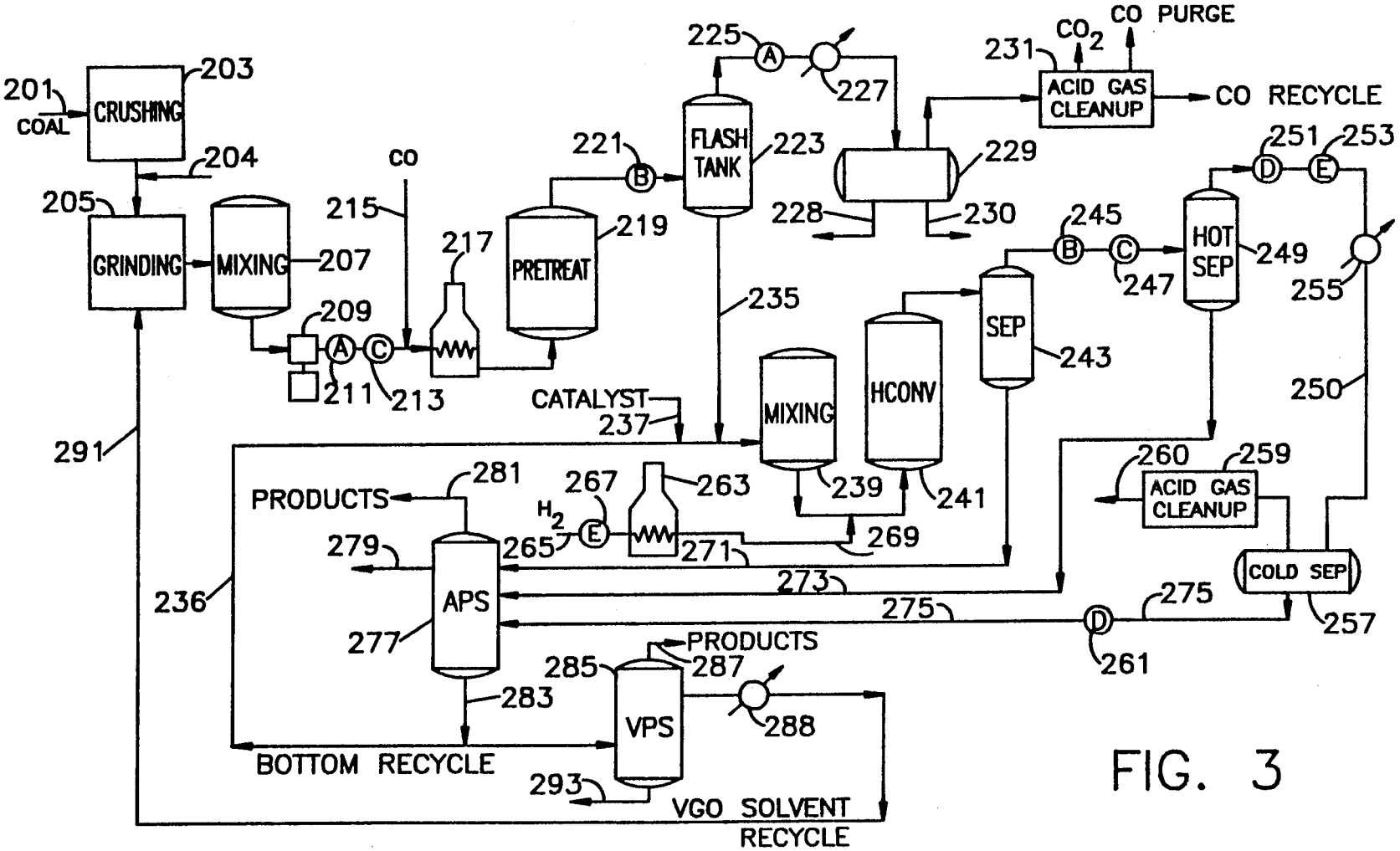
FIG. 3 shows a process flow diagram of an example of a process according to the present process.

The following is a prophetic process design for carrying out the invention. Reference is made to FIG. 3. As-received coal is introduced via line 201 into a crushing zone 203, where the coal is crushed in a conventional ball or rod mill to less than about ¼ inch in diameter particles. If the as-received coal is very wet, the coal may be dried in a conventional gas swept drier in order to prevent agglomeration during crushing. Following the crushing zone 203, it is optional to spray the coal with a sodium formate solution, introduced through line 204, to promote the subsequent pretreatment step. The crushed coal is then mixed with solvent (also referred to as "hot oil") in a solvent-to-dry coal ratio of about 1.5:1 and at a temperature of about 225° F. in hot oil grinding zone 205. This grinding step can be carried out in a conventional hot oil ball mill and reduces the coal slurry to a paint-like consistency with coal particles of about −100 to −200 mesh. The temperature of the hot oil solvent is such as to maintain it at a pumpable viscosity. The coal slurry then enters a mixing and/or hold-up tank 207, before being raised in pressure by pump 209. The pressurized coal slurry passes through heat exchangers 211 and 213. (The heat exchangers in FIG. 5 are designated with matching letters A, B, C, etc. to indicate where heat and cold sinks may be heat exchanged to optimize the thermal efficiency of the process.) Carbon monoxide is mixed with the coal slurry via line 215 and the coal slurry is further elevated in temperature by furnace 217 before entering pretreatment zone 219 for a residence time of about 90 minutes. The pretreatment zone is at a pressure of 3500 psi and a temperature of 600° F. The pretreated coal is further heated in heat exchanger 221 or furnace to a temperature of 675° F. and enters a flash tank 223 at a pressure of 2600 psi. The gaseous effluent from the flash tank is cooled in heat exchanger 225 and cooling water exchanger 227 to a temperature of 110° F., and condensed liquids are accumulated in tank 229, where two immiscible liquid phases form; a light solvent phase in line 228, which may be sent to the atmospheric pipestill, and a water phase (in line 230) containing soluble organics, which organics may be extracted out and sold for use in various products. The uncondensed gases from tank 229 are treated in an acid gas cleanup zone 231 to remove $CO_2$, and the remaining CO may be recycled to the pretreatment zone 219 or purged to a water-gas-shift reaction to make plant hydrogen. The liquid effluent, comprising a 1.8:1 weight ratio of solvent to treated coal, is removed from the flash tank 223 by line 235, and is admixed with a solvent atmospheric bottoms recycle in line 236. Catalyst for the hydroconversion reactions is introduced into the coal slurry via line 237. The coal and catalyst slurry then enters a mixing zone 239 at a temperature of 675° F. and a pressure of 2550 psi. A small amount of hydrogen may be added to the mixing zone to prevent regressive reactions. The mixed coal and catalyst slurry receives molecular hydrogen gas from a treat gas in line 269, which treat gas is supplied via line 265 and heated by furnace 263 and heat exchanger 267. The treat gas is heated to help raise the temperature of the overall mixture to meet hydroconversion conditions. The mixture of coal, solvent, treat gas and catalyst enters the hydroconversion zone 241, where it is subjected to a temperature of 800° F. and a pressure of 2500 psig for a period of about 90–120 minutes and at a ratio of solvent to treated coal to recycle bottoms of 1.8:1:0.5. One or a series of hydroconversion reactors may be employed. The effluent from the reactor 241 enters a gas-liquid separator 243, wherein the separated liquids are sent to atmospheric pipestill 277. The gases from gas-liquid separator 243, after being cooled in heat exchangers 245 and 247, enter a hot separator 249 at a temperature of 650° F. A condensed liquid phase is removed from hot separator 249 via line 273 and sent to an atmospheric pipestill 277. The uncondensed gases, after passing through heat exchangers 251 and 253 and cooling water exchanger 255, are sent via line 250 to a cold separator 257, where uncondensed gases are removed by line 260 following acid gas cleanup in zone 259. The gas stream can then be split (not shown) to make a recycle stream with hydrogen and a purge stream for hydrogen recovery. The condensed liquids from cold separator 257 are removed in line 275 and, after passing through heat exchanger 261, sent to the atmospheric pipestill 277. The atmospheric pipestill 277, which receives the liquid products from the hydroconversion reactor 241 and separator 229, produces an overhead gaseous stream 281 and a product stream 279, which may be sent to a hydrotreating zone (not shown) for final treatment. A portion of the bottoms from the atmospheric pipestill is sent via line 283 to a bottoms recycle stream 236 which, as described above, is mixed with the coal slurry and catalyst before hydroconversion. Another portion of the bottoms is sent to vacuum pipestill 285, where a further product stream 287 for hydrotreatment is produced. A bottoms stream 293 from the vacuum pipestill is sent as feed to a partial oxidation unit to produce part of the required CO and $H_2$. The vacuum pipestill 285 produces a distillate, with a boiling point of 650° to 1000° F., which distillate forms a VGO (vacuum gas oil) recycle stream. After passing through heat exchanger 288, the VGO is recycled via line 291 for admixture with in-coming coal in the hot oil grinding zone 205, as mentioned above.

It will be understood that while there have been herein described certain specific embodiments of the invention, it is not intended thereby to have it limited to or circumscribed by the details given, in view of the fact that the invention is susceptible to various modifications and changes which came within the spirit of the disclosure and the scope of the appended claims.

What is claimed is:

1. A process for hydroconverting coal to produce a hydrocarbonaceous liquid which comprises the steps of:

(a) forming a mixture comprising coal, carbon monoxide and an organic solvent, wherein the ratio of water-to-dry coal at pretreatment conditions is not more than 0.5:1, and subjecting the mixture to an elevated temperature and pressure effective to cause depolymerization and hydrogenation of the coal to a significant extent;

(b) removing gases from the coal and organic solvent mixture;

(c) forming a subsequent mixture of pretreated coal, organic solvent, and a catalyst, wherein the catalyst is comprised of dispersed particles of a metal sulfide-containing compound, said metal being selected from the group consisting of Groups VA, VIA, VIIA and VIIIA of the Periodic Table of the Elements and mixtures thereof;

(d) reacting the resulting mixture containing said catalyst under coal hydroconversion conditions in the presence of hydrogen, in a hydroconversion zone;

(e) separating the contents of said hydroconversion zone into at least three fractions:

(1) an effluent product comprising a hydrocarbonaceous liquid, essentially free of coal residue solids; (2) a bottoms comprising coal residue solids; and (3) a gaseous top.

2. A process for hydroconverting coal to produce a hydrocarbonaceous liquid which comprises the steps of:

(a) forming a mixture comprising a water-containing coal, carbon monoxide and an organic solvent in a pretreatment zone, wherein the ratio of water-to-dry coal at pretreatment conditions is not more than 0.5:1, and subjecting the mixture to a temperature within the range of 550° to 700° F. and pressure of at least 1800 psi to cause depolymerization and hydrogenation of the coal to a significant extent;

(b) removing gases from the coal organic solvent mixture;

(c) forming a subsequent mixture of pretreated coal, organic solvent, and a catalyst, wherein the catalyst is comprised of dispersed particles of a metal sulfide-containing compound, said metal being selected from the group consisting of Groups VA, VIA, VIII and VIIIA of the Periodic Table of the Elements and mixtures thereof;

(d) reacting the resulting mixture containing said catalyst under coal hydroconversion conditions in the presence of hydrogen, in a hydroconversion zone;

(e) separating the contents of said hydroconversion zone into at least three fractions: (1) an effluent product comprising a hydrocarbonaceous liquid, essentially free of coal residue solids; (2) a bottoms comprising coal residue solids; and (3) a gaseous top; and (f) upgrading the hydrocarbonaceous liquid from step (e) by treatment with hydrogen.

3. The process of claim 2, wherein the catalyst is a conversion product of an oil-soluble organometallic compound.

4. The process of claim 3, wherein step (d) is carried out at 650° F. to 850° F.

5. The process of claim 3 wherein said oil-soluble metal compound is selected from the group consisting of inorganic compounds, salts of organic acids, organometallic compounds and salts of organic amines.

6. The process of claim 5 wherein said oil soluble metal compound is selected from the group consisting of salts of acyclic aliphatic carboxylic acids and salts of alicyclic aliphatic carboxylic acids.

7. The process of claim 6 wherein said oil soluble metal compound is molybdenum naphthenate.

8. The process of claim 6 wherein said oil soluble metal compound is phosphomolybdic acid.

9. The process of claim 5 wherein said oil soluble metal compound is a salt of naphthenic acid.

10. The process of claim 3 wherein said oil-soluble metal compound is converted to a catalyst by first heating a mixture of said soluble metal compound, coal and solvent to the temperature ranging from about 615° F. to about 820° F. in the presence of hydrogen-containing gas to form a catalyst within said mixture and subsequently reacting the resulting mixture containing the catalyst with hydrogen under coal liquefaction conditions.

11. The process of claim 3 wherein said oil soluble metal compound is converted in the presence of a hydrogen-containing gas in the coal liquefaction zone under coal liquefaction conditions, thereby forming said catalyst in-situ within said mixture in said liquefaction zone.

12. The process of claim 2, further comprising recycling the solvent, with or without intervening hydrogenation, to said hydroconversion zone.

13. The process of claim 2, comprising separating the effluent product of the hydroconversion zone into at least two fractions, a relatively light fraction collected as product and a relatively heavy fraction recycled for further conversion in the hydroconversion zone.

14. The process of claim 2, wherein at least a portion of the bottoms is subjected to partial oxidation, whereby a portion of the carbon monoxide for step (a) is produced and a portion of the hydrogen for step (d) is produced.

15. The process of claim 2, wherein unpretreated coal is subjected to partial oxidation to generate a portion of the carbon monoxide for step (a) and a portion of the hydrogen for step (d).

16. The process of claim 2, comprising the additional steps of separating at least a portion of said bottoms from said hydroconversion zone and recycling said portion to said hydroconversion zone.

17. The process of claim 2, wherein the top is a gaseous mixture comprising hydrogen, and wherein, in a separation zone, the gases are removed overhead and hydrogen is thereafter recycled to the hydroconversion zone.

18. The process of claim 2, wherein the ratio of organic solvent-to-dry coal in step (a) is 4:1 to 1:1.

19. The process of claim 2, wherein the inlet ratio of water-to-dry coal in step (a) is below about 1:1.

20. The process of claim 2, further comprising introducing the hydrocarbonaceous liquid into a fractionation zone, wherein at least two fractions are obtained and whereby at least one fraction is recycled to the liquefaction zone.

21. The process of claim 2, wherein step (a) is carried out at 550° F. to 650° F.

22. The process of claim 2, wherein the partial pressure of carbon monoide is about 800 to 4500 psi.

* * * * *